United States Patent [19]

Inoue et al.

[11] Patent Number: 4,877,709

[45] Date of Patent: Oct. 31, 1989

[54] IMAGE FORMING MEMBER FOR ELECTROPHOTOGRAPHY

[75] Inventors: Eiichi Inoue, Tokyo; Isamu Shimizu; Toshiyuki Komatsu, both of Yokohama, all of Japan

[73] Assignee: Canon Kabushiki Kaisha, Tokyo, Japan

[21] Appl. No.: 226,556

[22] Filed: Aug. 1, 1988

Related U.S. Application Data

[60] Division of Ser. No. 141,158, Jan. 6, 1988, abandoned, which is a division of Ser. No. 77,102, Jul. 23, 1987, Pat. No. 4,737,428, which is a division of Ser. No. 923,027, Oct. 24, 1986, Pat. No. 4,701,394, which is a continuation of Ser. No. 358,356, Mar. 16, 1982, Pat. No. 4,673,628, which is a continuation of Ser. No. 131,495, Mar. 18, 1980, abandoned.

[30] Foreign Application Priority Data

Mar. 26, 1979 [JP] Japan ..... 54-35313

[51] Int. Cl.[4] ..... G03G 5/082

[52] U.S. Cl. ..... 430/128; 427/39

[58] Field of Search ..... 430/128; 427/39

[56] References Cited

U.S. PATENT DOCUMENTS

| | | | |
|---|---|---|---|
| 3,041,166 | 6/1962 | Bandeer | 430/60 X |
| 3,245,833 | 4/1966 | Trevoy | 430/63 X |
| 3,285,740 | 11/1966 | Weigl et al. | 430/63 X |
| 3,607,388 | 9/1971 | Hori et al. | 252/501.1 |
| 3,649,116 | 3/1972 | Hall | 430/66 X |
| 3,684,503 | 8/1972 | Humphriss et al. | 430/66 X |
| 3,953,207 | 4/1976 | Horgan | 430/58 |
| 3,973,960 | 8/1976 | Dulken et al. | 430/128 X |
| 4,034,127 | 7/1977 | Busanovich et al | 430/128 X |
| 4,064,521 | 12/1977 | Carlson | 357/2 |
| 4,069,356 | 1/1978 | Fischer | 430/128 X |
| 4,134,764 | 1/1979 | Huffmann | 430/82 X |
| 4,147,667 | 4/1979 | Chevallier et al. | 252/501.1 |
| 4,202,937 | 5/1980 | Fukuda et al. | 430/58 |
| 4,217,374 | 8/1980 | Oushinsky et al. | 427/74 X |
| 4,225,222 | 9/1980 | Kempter | 430/57 X |
| 4,226,898 | 10/1980 | Ovshinsky et al. | 427/74 X |
| 4,394,425 | 7/1983 | Shimizu et al. | 430/60 X |
| 4,409,308 | 10/1983 | Shimizu et al. | 430/60 |
| 4,451,547 | 5/1984 | Hirai et al. | 430/128 |

FOREIGN PATENT DOCUMENTS

| | | | |
|---|---|---|---|
| 745570 | 11/1966 | Canada | 430/66 |
| 49-8352 | 2/1974 | Japan | 430/128 |

OTHER PUBLICATIONS

Moustakas et al., "Preparation of Highly Photoconductive Amorphous Silicon by RF Sputtering", Solid State Comm., vol. 23, No. 3, pp. 155–158 (1977).

Thompson et al., "RF Sputtered Amorphous Silicon Solar Cells", Proc. Int'l. Photovoltaic Solar Energy Conf., Luxembourg, Sep. 1977, pp. 231–240.

*Primary Examiner*—Roland E. Martin

*Attorney, Agent, or Firm*—Fitzpatrick, Cella, Harper & Scinto

[57] ABSTRACT

An image-forming member for electrophotography comprises a photoconductive layer including as constituting layers, a hydrogenated amorphous silicon layer and an amorphous inorganic semiconductor layer. The amorphous inorganic semiconductor layer is laminated on the hydrogenated amorphous silicon layer to thereby provide a heterojunction.

1 Claim, 2 Drawing Sheets

IMAGE FORMING MEMBER FOR ELECTROPHOTOGRAPHY

This application is a division, of application Ser. No. 141,158, filed Jan. 6, 1988, now abandoned which in turn is a division of application Ser. No. 077,102, filed July 23, 1987, now issued as U.S. Pat. No. 4,737,428, which is turn is a division of application Ser. No. 923,027, filed Oct. 24, 1986, now issued as U.S. Pat. No. 4,701,394, which in turn is a continuation of application Ser. No. 358,356, now issued as U.S. Pat. No. 4,673,628, which is turn is a continuation of application Ser. No. 131,495, filed Mar. 18, 1980, now abandoned.

BACKGROUND OF THE INVENTION

1. Field of the Invention

The present invention relates to an image-forming member for electrophotography which is sensitive to electromagnetic wave such as light including for example ultraviolet ray, visible ray, infrared ray, x ray and gamma ray.

2. Description of the Prior Art

Photoconductive materials for constituting a photoconductive layer in an image-forming member for electrophotography are required to exhibit various properties, for example high sensitivity, high resistance, spectral characteristics as close to luminosity as possible, high speed of light response, large coefficient of light absorption in the range of visible light and excellent stability to external influence such as light, heat and the like. In addition, they are required to be non-harmful or hardly harmful to man.

Particularly, in case of an electrophotographic image-forming member incorporated into an electrophotographic apparatus used as office supplies, a problem of harmfulness during use of the apparatus is very important and serious. However, it can be hardly asserted positively that materials of the prior art, for example inorganic photoconductive materials such as Se, CdS, ZnO and the like, and organic photoconductive materials ($PVC_z$), trinitrofluorenone (TNF) and the like always satisfy all of the foregoing requirements over a certain level.

For example, an electrophotographic image-forming member provided with an Se-type photoconductive layer to which Te or As is incorporated possesses improved spectral sensitivity range. However, it is inadvantageous that since its light fatigue become larger, when copying operation is continuously repeated with the same, one original, the image density of the copied images is decreased, and the background of the images is stained, that is, fogging phenomenon takes place in the white ground. Further, when the copying operation is successively reopened by using a new original, undesired images are obtained in which images of the last original inadvantageously appear as residual images, that is, ghost phenomenon takes place.

Inorganic photoconductive materials such as CdS, ZnO and the like are used for so-called binder type photoconductive layer which is formed by processing the materials into granular form and dispersing them into an organic polymerizable binder of electrically insulating property. However, the binder type photoconductive layer is essentially composed of two components, i.e. photoconductive material and resin binder and required to be a system in which the photoconductive material particles must be uniformly dispersed into the binder. As a result, such photoconductive layer includes many parameters for determining electric, photoconductive, physical and chemical properties thereof. Therefore, if such many parameters are not carefully controlled a photoconductive layer having the desired properties cannot be obtained with good reproducibility. It is further inevitable that the yield is decreased so that such photoconductive layer is lacking in the mass-producibility.

The photoconductive layer of binder type is porous as a whole due to a special structure of dispersion system so that it depends greatly upon humidity. When it is used in the atmosphere of a high humidity, its electric property is deteriorated. As a result, there are not a few cases in which copied images of high quality cannot be obtained.

Further, owing to the porosity of the binder type photoconductive layer, developer is allowed to enter into the layer, which results in deteriorating release property and cleaning property and ultimately leads to impossible use. In particular, when the used developer is a liquid developer, it penetrates into the photoconductive layer along with the carrier solvent by capillary action so that the above disadvantages are enhanced.

Electrophotographic image-forming members using organic photoconductive materials such as poly-N-vinylcarbazole, trinitrofluorenone and the like have such drawbacks that they are lacking in moisture resistance, corona ion resistance and cleaning property and have only low photosensitivity and narrow spectral sensitivity range to the visible light region with the sensitivity being partial to a shorter wave length region. Therefore, such members are used only in the extremely restricted field.

In view of the foregoing, it is desired to develop a third material for providing a photoconductive layer free from the above-mentioned drawbacks.

Such a material is, for example amorphous silicon (hereinafter called "a-Si") which is recently considered to be promising. At the beginning of developing an a-Si layer, its structure varies depending upon the producing methods and conditions so that its electric and optical properties also vary and the reproducibility is questionable. However, in 1976 success of producing p-n junction in a-Si, which has been considered impossible, was reported (Applied Physics Letters, Vol. 28, No. 2, pp. 105–107, Jan. 15, 1976). Since then, the a-Si draws attentions of scientists and is studied and developed for application mainly to solar cells.

However, in practice, such an a-Si developed for solar cell cannot be directly used as a material for a photoconductive layer of an electrophotographic image-forming member from the viewpoints of its electric, optical and photoconductive properties. Solar cells take out solar energy in the form of electric current, and therefore the a-Si film must have a relatively low resistance for the purpose of obtaining efficiently the electric current with a good SN ratio, i.e. photo-current (ip) / dark current (id), but if the resistance is too low, the photosensitivity is deteriorated and the SN ratio is degraded. Therefore, the resistance should be $10^5$–$10^8$ ohm·cm.

However, such a degree of resistance (dark resistance) is so low for a photoconductive layer of an electrophotographic image-forming member that such an a-Si film cannot be used for the photoconductive layer.

Further, reports concerning a-Si films disclose that when the dark resistance is increased, the photosensitivity is lowered. For example, an a-Si film having a dark resistance of about $10^{10}$ ohm·cm shows a lowered photoconductive gain, i.e. photocurrent per incident photon. Therefore, the conventional a-Si films cannot be used for a photoconductive layer even from this point of view. In addition, an electrophotographic image-forming member of two-layer structure including a photoconductive layer of the conventional a-Si and a substrate exhibits high speed of dark decay, in other words, poor charge retentivity. Therefore, such an image-forming member cannot provide satisfactory images or perform any image formation at a process speed for the electrophotographic process as known at present.

The conventional a-Si has additionally many drawbacks to be resolved. For example, the a-Si cannot be given a uniform photosensitivity to the whole region of the visible light, particularly with the sensitivity being lowered at the side of shorter wave length in the vicinity of 400 nm. In order to produce an a-Si layer having desired properties over a large area, the producing conditions must be carefully controlled. The layer growth ratio of a-Si is remarkably low, for example as low as about 1/100 of that of Se and the like, which requires careful control of the layer-forming conditions for a long period of time in case of obtaining a layer having a sufficient thickness for a photoconductive layer of electrophotographic image-forming member. In some cases, it is necessary to retain the layer-forming conditions constantly.

The present invention has been accomplished in the light of the foregoing. The present inventors have continued researches and investigations with great zeal concerning many photoconductive materials including a-Si from a viewpoint that a-Si is applied to a photoconductive layer of an electrophotographic image forming member without damaging the advantages of the a-Si. As a result, they have succeeded in designing and manufacturing electrophotographic imageforming members which are able to eliminate all problems as mentioned above.

SUMMARY OF THE INVENTION

A primary object of the present invention is to provide an electrophotographic image-forming member which is stable in electric, optical and photoconductive properties at all times, remarkably excellent in photosensitivity, light fatigue resistance and heat resistance, and is not deteriorated even when repeatedly used.

Another object of the present invention is to provide an electrophotographic image-forming member which can give high quality images having a high density, sharp halftone and high resolution.

A further object of the present invention is to provide an electrophotographic image-forming member which has a wide spectral sensitivity range covering almost all the visible light range, a low dark decay speed and a fast photoresponse property.

A still further object of the present invention is to provide an electrophotographic image-forming member which is excellent in abrasion resistance, cleaning property, and solvent resistance.

Still another object of the present invention is to provide an electrophotographic image-forming member which has a substantially uniform photosensitivity covering the whole range of the visible light and a relatively large light absorption coefficient in the visible light region.

According to the present invention, there is provided an image-forming member for electrophotography comprising a substrate and a photoconductive layer, said photoconductive layer including as constituting layers, a hydrogenated amphorous silicon (hereinafter called "a-Si:H") layer and an amphorous inorganic semiconductor (hereinafter called "a-inorganic semiconductor") layer, said a-inorganic semiconductor layer being laminated on said a-Si:H layer to thereby provide a heterojunction.

DETAILED DESCRIPTION OF THE PREFERRED EMBODIMENTS

Figure 1:
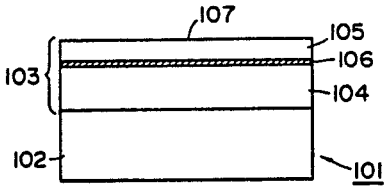
FIG. 1 is a schematic cross-sectional view of the most typical layer structure of an electrophotographic image-forming member according to the present invention.

An image-forming member for electrophotography according to the present invention comprises a layer structure which is schematically illustrated as the most typical structure in FIG. 1. In this drawing, there is shown an image-forming member 101 composed of a substrate 102 for electrophotography and a photoconductive layer 103 overlying the substrate. The photoconductive layer 103 has a free surface 107.

The photoconductive layer 103 is composed of layers 104 and 105, one of which is composed of a-Si:H formed in such a manner as described later, the other is composed of a-inorganic semiconductor, thereby providing a heterojunction portion 106 between the two layers.

In the present invention, the a-Si:H layer may be formed from one kind of a-Si:H selected from the types (1)–(3) of a-Si:H as given below. Alternatively, at least two kinds of a-Si:H may be selected from the types (1)–(3) and formed into different layers in a contrast state.

Types of a-Si:H (1) n-Type: Only donor is contained, or both of donor and acceptor are contained provided that the concentration of the donor, represented by Nd, is higher than that of the acceptor, represented by Na;

(2) p-Type: Only acceptor is contained, or both of donor and acceptor are contained provided that the concentration of the acceptor, Na, is higher than that of the donor.

(3) i-Type: $Na \simeq Nd \simeq O$, or $Na \simeq Nd$

A layer composed of a-Si:H of the types (1)–(3), which is used for constituting the photoconductive layer, may be formed in such a manner that such layer is doped with n-type impurities, p-type impurities or both types of impurities in a controlled amount thereof when it is formed by glow discharging method or reactive sputtering method as described later. In this case, according to the finding of the applicants resulting from the test data, a-Si:H layers having conductivities in the range from stronger n-type to weaker n-type or stronger p-type to weaker p-type may be formed by controlling the concentration of the impurities in the layer to within the range of $10^{15}$ to $10^{19}$ $cm^{-3}$.

The a-Si:H layer of the types (1)–(3) may be formed, for example by glow discharging, sputtering, ion implantation, ion plating methods. These methods may be selected optionally. Selection depends upon manufacturing conditions, degree of capital investment, manufacturing scale and electric, optical, photoconductive properties, etc required for the desired photoconductive layer. Above all, the glow discharging method is preferable in that control is relatively easy in forming the desired photoconductive layer and impurities of Group III or V in the Periodic Table can be introduced, in substitution type into a-Si:H layer when the layer is controlled to the type (1), (2) or (3) as mentioned above by doping it with impurites.

During formation of an a-Si:H layer, H is introduced into the layer in such a manner that gas of a compound such as $SiH_4$, $Si_2H_6$ and the like or $H_2$ (hydrogen gas) is introduced into a manufacturing apparatus and then decomposed by gas discharge, and as a result H is incorporated into the layer as it grows.

The present applicants have found that the amount of H in the a-Si:H layer is a very important factor for determining whether or not the image-forming member to be produced can be used for practical application with excellent results. In the present invention, as for an image-forming member which can be satisfactorily applied to practical use, it is desired that the amount of H in the a-Si:H layer is controlled to generally 1–40 atomic percent, more preferably 5–30 atomic percent.

For example, in case that an a-Si:H layer is formed from hydrogenated silicon gas such as $SiH_4$, $Si_2H_6$ and the like as the starting material by utilizing glow discharge, such a hydrogenated silicon gas is decomposed by the discharge so that H is automatically introduced into the a-Si:H layer during formation of such layer. Alternatively, $H_2$ gas may be introduced into the apparatus for glow discharge at the time of forming an a-Si:H layer with a view to performing more effective introduction of H into the layer.

In case of utilizing the sputtering method, when the sputtering method is carried out for example with a target of Si in an atmosphere of an insert gas such as argon etc. or a gas mixture based on the insert gas, H may be introduced into the resulting a-Si:H layer if $H_2$ gas or hydrogenated silicon gas such as $SiH_4$ and $Si_2H_6$ is brought into that atmosphere. Alternatively, gas such as $B_2H_6$, $PH_3$ and the like may be introduced into the atmosphere. In the latter case, introduction of H into the layer may be effected simultaneously with doping of the layer with the impurities.

The a-Si:H layer can be controlled to the type of (1), (2) or (3) as mentioned in the foregoing by doping the layer with impurities during formation of the layer.

As for impurities to be doped into the a-Si:H layer, when the layer is controlled to the p-type one, elements of Group IIIA in the Periodic Table, for example B, Al, Ga, In and Tl are preferable; when the layer is controlled to the n-type one, elements of Group VA in the Periodic Table, for example N, P, As, Sb and Bi are preferable. The amount of the impurities in the a-Si:H layer may be optionally determined depending upon electric, optical and photoconductive properties as required. As to the impurities of Group IIIA, the amount is usually $10^{-6}$–$10^{-3}$ atomic percent, preferably $10^{-5}$–$10^{-4}$ atomic percent. As to the impurities of Group VA, the amount is usually $10^{-8}$–$10^{-3}$ atomic percent, preferably $10^{-8}$–$10^{-4}$ atomic percent.

The method of doping the a-Si:H layer with those impurities varies upon the technique utilized for forming the layer. Preferred manners for that purpose will be explained in the following description and working examples.

The thickness of the a-Si:H layer may be optionally determined on the basis of mutual relationship to another layer so as to obtain a photoconductive layer of the desired electrophotographic properties. The a-Si:H layer has a thickness of generally 0.3–50 microns, preferably 0.5–30 microns, optimumly 0.8–20 microns.

The a-inorganic semiconductor layer of the present invention may be composed of an a-inorganic semiconductor material which is able to provide a heterojunction portion of excellent electric property when the a-inorganic semiconductor layer is laminated on the a-Si:H layer and increase the photosensitivity range of the whole photoconductive layer within the visible light region as compared with the case of single a-Si:H layer.

The a-inorganic semiconductor layer may be of a relatively low dark resistance as compared with the conventional one since the photoconductive layer of the present invention is provided with a junction portion in the inside thereof. However, it is preferable to form the a-inorganic semiconductor layer with a dark resistance of $10^{11}$ ohm.cm or above in that the condition for preparing an electrophotographic image-forming member of the desired electrophotographic properties as well as materials for forming the layer can be freely selected within a sufficiently broad range.

For the purpose of attaining more effectively the object of the present invention, it is desired to form the a-inorganic semiconductor layer from an a-inorganic semiconductor material having a band gap $\epsilon_g$ which is larger than band gap $E_g$ of an a-Si:H material for constituting the a-Si:H layer. For example, with a view to providing the image-forming member with substantially uniform or constant photosensitivity to the whole range of visible light and with an increased coefficient of light absorption, an a-inorganic semiconductor having band gap $\epsilon_g$ of $2.1 \pm 0.4$ eV may be preferably selected and formed into a layer.

The material for constituting the a-inorganic semiconductor layer may include various a-inorganic semiconductor materials, for example chalcogen compounds composed of chalcogen elements Se, Te and S singly or in combination; a-inorganic semiconductor materials, for example chalcogen compounds containing a chalcogen element and other element, such as chalcogen compounds containing at least one chalcogen element and As, Ge and/or Si, chalcogen compounds containing at least one chalcogen element and metal element such as Ag and/or Cu in a small amount and chalcogen compounds containing at least one chalcogen element and As, Ge and/or Si and Ag and/or Cu; silicon oxides of the formula $SiO_x$ ($0<x<2$); and a-inorganic semiconductor materials such as a-Si:H containing O in a small amount (e.g. $10^2$–$10^5$ ppm) (this material is called a-Si:H (O) hereinafter); and a-Si:H containing C in a small amount (e.g. $10^2$–$10^5$ ppm). More specifically, as preferable chalcogen compounds, there may be mentioned for example $As_2Se_3$, $As_2Se_3$ containing about 0.2% of Ag, $As_2S_3$, $As_2S_3$ containing about 0.2% of Ag, $AsSe_{19}$, $Se_{19}S$, $Se_{99}Ge$, $Se_9Te$, $AsSe_9$ and $As_2Se_2Te$.

Among the a-inorganic semiconductor layer-forming materials as listed above, a desired material capable of satisfying the foregong requirement is selected, taking account of mutual relation to the properties required for the a-Si:H layer to be laminated on the a-inorganic semiconductor layer, so as to provide satisfactory conformability with the a-Si:H layer.

The thickness of the a-inorganic semiconductor layer may be arbitrarily determined depending on the electrophotographic property and practical applicability required for the designed image-forming member. It is desired to be generally 0.1–70 microns, preferably 0.2–60 microns, optimumly 0.2–50 microns. Selection of the thickness from the numerical range is made, for example taking account of the function to be assigned to the a-inorganic semiconductor layer for the purpose of attaining effectively the properties required for the photoconductive layer as a whole and in consideration of the material to be selected as one for forming the a-inorganic semiconductor layer for that purpose. For example, in case of making the a-inorganic semiconductor layer function mainly as an electric barrier layer, the lower limit for the thickness may be 0.1 micron while the upper limit may be 1.0 micron. When the function of performing the main portion of the electric capacity required for the photoconductive layer, in addition to the function as a barrier layer, is entrusted to the a-inorganic semiconductor layer, the thickness is set within 1.0–60 microns. Further, when the a-inorganic semiconductor layer is made mainly to perform the function of the electric capacity as well as a part of the function as a charge generating layer for generating charges upon light irradiation, the thickness is determined within a range of 1.0–70 microns. Furthermore, when the a-inorganic semiconductor layer is required mainly to have the function as a barrier layer as well as a part of the function as a charge generating layer, the thickness is set within 0.2–50 microns.

In the present invention, it is a very important factor for attaining more effectively the object of the present invention that the polarities of the conductivity types of the materials for forming the layers 104 and 105 are appropriately selected so as to provide a heterojunction portion 106. Specifically, in order to produce remarkably inverse bias effect in the heterojunction portion 106 to be formed between the layers 104 and 105 and improve dark decay property to a great extent, the following combinations are preferable. For example, in case that the layer 104 is of n-type, the layer 105 is of p-type; as for the layer 104 of p-type, the layer 105 is of n-type; in case of the layer 104 of n-type or p-type, the layer 105 is of i-type; and when the layer 104 is of i-type, the layer 105 is of n-type of p-type. As typical examples of the combination, there may be mentioned a lamination composed of n-type a-Si:H layer and p-type a-inorganic semiconductor layer of a chalcogenide glass system, a lamination composed of p-type a-Si:H layer and n-type a-inorganic semiconductor layer of material $SiO_x$, and the like.

FIG. 1 illustrates the most typical structure of the electrophotographic image-forming member, wherein only one heterojunction portion in the photoconductive layer 103 is shown. It should be noted that the image-forming member of the present invention is not limited to that structure. The photoconductive layer 103 may be composed of multiple layer structure, which provides a plurality of heterojunction portions therein, to such an extent that the structure does not obstruct the attainment of the object of the present invention. For example, an a-Si:H layer, a-inorganic semiconductor layer and a-Si:H layer may be formed in the name order on the substrate 102 to provide a photoconductive layer of a multiple layer structure; and an a-inorganic semiconductor layer, a-Si:H layer and a-inorganic semiconductor layer may be laminated in the named order on the substrate 102.

The electrophotographic image-forming member having a photoconductive layer as mentioned above is provided with uniform electric, optical and photoconductive properties in the whole surface, the uniformity of which properties does not vary with teh elapse of time. Surprisingly, the image-forming member is also excellent in other properties such as electrostatic property, corona ion resistance, solvent resistance, abrasion resistance and cleaning property so that the electrophotographic property of such member is hardly deteriorated even if repeated used many times. Further, the image-forming member possesses substantially uniform or constant photosensitivity covering the entire range of visible light and is provided with other many improved properties, for example larger light absorption coefficient in the range of visible light, higher light response speed and lower dark decay speed.

In the foregoing, the photoconductive layer 103 is explained which is composed of an a-Si:H layer and a-inorganic semiconductor layer, both being formed from different materials. However, the photoconductive layer may be designed to have a third layer as the constituting layer in addition to the two kinds of layers. For example, it is possible to add the third layer capable of performing charge-transporting function, which is one of the functions required for the photoconductive layer.

The charge-transporting layer may be effectively composed of a material which is able to provide an electrically good junction between the charge-transporting layer and a layer to be formed in contact with the former layer so that charges generated upon light irradiation may be injected effectively from the latter contacting layer to the charge-transporting layer and is capable of transporting the charges with good efficiency. As the material for the charge-transporting layer, there may be mentioned many organic semiconductive materials (OPC). The following materials may be exemplified as useful ones.

For example, carbazoles such as polyvinylcarbazole ($PVC_z$), carbazole, N-ethylcarbazole, N-isopropylcarbazole, N-phenylcarbazole and the like; pyrenes such as pyrene, tetraphenylpyrene, 1-methylpyrene, azapyrene, 1-ethylpyrene, 1, 2-benzpyrene, 2,4-benzpyrene, 4,5-benzpyrene, acetylpyrene, 1,4-bromopyrene, polyvinylpyrene and the like; anthracene, tetracene, tetraphene, perylene, phenanthrene, 2-phenylnaphthalene, and the like; chrysenes such as chrysene, 2,3-benzochrysene, picene, benzo(b)chrysene, benzo(c)chrysene, benzo(g)chrysene and the like; phenylindole and the like; aromatic heterocyclic polyvinyl compounds such as polyvinyltetracene, polyvinylperylene, polyvinylpyrene, polyvinyltetraphene and the like; polyacrylonitrile and the like; fluorene, fluorenone and the like; polyazophenylene and the like; pyrazoline derivatives such as 2-pyrazoline, pyrazoline hydrochloride, pyrazoline picrate, N-p-tolyl-pyrazoline and the like; polyimidazopyrrolone, polyimidimidazopyrrolone, and the like; polyimide, polyimidoxazole, polyamidobenzimidazole, poly-p-phenylene and the like; erythrosine and the like; 2,4,7-trinitro-9-fluorenone (TNF), $PVC_z$: TNF, 2,4,5,7-tetranitrofluorenone and the like; and dinitroanthracene, dinitroacridine, tetracyanophyrene, dinitroanthraquinone and the like.

The thickness of the charge-transporting layer may be optionally determined depending upon the properties required for the purpose of attaining the object of the present invention and the relation to a charge generating layer. It may be generally 5–70 microns, preferably 10–60 microns.

The total thickness of the photoconductive layer as a whole is designed so that the layers constituting the photoconductive layer may be of respective thicknesses selected from the numerical ranges desscsribed in the foregoing so as to perform satisfactorily the functions thereof. In addition, the total thickness may be optionally determined depending upon the desired electrophotographic property, particularly electric, optical and photoconductive properties, type of electrophotographic process as adopted and using conditions, e.g. whether flexibility is required or not. It is generally 1–80 microns, preferably 2–70 microns, optimumly 2–50 microns.

The substrate 102 may be formed from any material as conventionally used in the field of electrophotographic technology as far as an electric junction state of the desired properties can be obtained between the substrate 102 and a layer formed directly on the substrate. Preferable substrates are exemplified below.

Electrically conductive substrates composed of stainless steel, or metals such as Al, Cr, Mo, Au, Ir, Nb, Ta, V, Ti, Pt, Pd and the like, or alloys of these metals; electrically conductive substrates provided with surfaces of those metals; films or sheets of synthetic resins having heat resistance, particularly capable of exhibiting heat resistance at least at a temperature adopted in forming a photoconductive layer: electrically insulating substrates composed of glass or ceramics, and other similar substrates.

The substrate is cleaned before a photoconductive layer is formed thereon. In general, for example as for metallic substrates, they are brought into contact with an alkaline or acidic solution to clean the surface thereof effectively by etching them. The thus cleaned substrate is dried in pure atmosphere, and when additional preliminary treatment is not needed, it is then placed at a predetermined position in a deposition chamber of an apparatus for forming a photoconductive layer on the substrate.

The electrically insulating substrate may be treated, if desired, to make the surface thereof electrically conductive. For example, in case of a glass substrate, the surface is conductivized with $In_2O_3$, $SnO_2$ or the like. In case of a substrate of a synthetic resin film such as polyimide, the surface is conductivized by vacuum vapor deposition, electron beam vapor deposition, sputtering or the like using a metal such as Al, Ag, Pb, Zn, Ni, Au, Cr, Mo, Ir, Nb, Ta, V, Ti, Pt or the like, or by laminating with such a metal.

The substrate may be shaped into a cylindrical or drum, belt, plate, other optional shape. When a continuous high-speed copying is designed, an endless belt or cylindrical shape is desirable.

The thickness of the substrate may be optionally determined so as to produce the desired electrophotographic image-forming member. When the image-forming member is desired to be flexible, it is preferable that the substrate is made as thin as possible, provided that the essential function of the substrate is performed. However, in such a case, the thickness is usually at least 10 microns from the viewpoints of manufacturing, handling and mechanical strength of the substrate. In the electrophotographic image-forming member, such as the member shown in FIG. 1, comprising a photoconductive layer (e.g. 103) provided with a free surface (e.g. 107) to which charging treatment is applied for the purpose of forming an electrostatic image, it is more preferable to dispose a barrier layer capable of preventing carriers from being injected from the substrate (e.g. 102) side upon the charging treatment, between the photoconductive layer and substrate. The materials for forming such barrier layer may be optionally selected depending upon the type of the substrate and electric property of the photoconductive layer. Typical materials may include metals such as Au, Ir, Pt, Rh, Pd, Mo and the like, insulating inorganic oxides such as $Al_2O_3$ and the like, $MgF_2$, insulating inorganic ompounds such as polyethylene, polycarbonate, polyurethane, polypara-xylylene and the like.

The photoconductive layer 103 may be provided with a surface covering layer thereon depending upon the electrophotographic process to be adopted. The properties required for the surface covering layer depend upon the type of the electrophotographic process. For example, when an electrophotographic process as described in U.S. Pat. Nos. 3,666,363 or 3,734,609 is employed, the surface covering layer is required to have electrically insulating property and sufficient electrostatic charge retentivity when it receives the charging treatment and further have a thickness over a certain level. On the other hand, in case of an electrophotographic process such as Carlson process, the thickness of the surface covering layer is required to be very thin since it is desired that after formation of an electrostatic image the electric potential at the light portion is very small. The surface covering layer is formed taking into consideration the desired electric property, electric contact with and adhesivity to the photoconductive layer, humidity resistance, abrasion resistance, cleaning property and the like. Further, the surface layer should not adversely affect the photoconductive layer in chemical and physical points.

As typical materials for constituting the surface covering layer, there may be mentioned for example synthetic resins such as polyethylene terephthalate, polycarbonate, polypropylene, polyvinyl chloride, polyvinylidene chloride, polyvinyl alcohol, polystyrene, polyamide, polyethylene tetrafluoride, polychrylene trifluorochloride, polyvinylidene fluoride, propylene hexafluoride-ethylene tetrafluoride copolymer, ethylene trifluoride-vinylidene fluoride copolymer, polybutene, polyvinyl butyral, polyurethane and the like; and cellulose derivatives such as cellulose diacetate, cellulose triacetate and the like. These synthetic resins and cellulose derivatives may be provided, in the form of a film, on the photoconductive layer by the sticking manner. Alternatively, they may be formed into a coating liquid, which is than coated onto the photoconductive layer to form a surface covering layer.

The thickness of the surface covering layer may be optionally determined depending upon the desired properties. Generally, it is about 0.5–70 microns. Particularly, when such layer acts only as a layer for protecting the photoconductive layer, the thickness may be usuallly 10 microns or below, while when it is required to function as an electrically insulating layer, the thickness may be usually 10 microns or above.

The invention will be understood more readily by reference to the following examples; however, these examples are intended to illustrate the invention and are not to be construed to limit the scope of the invention.

EXAMPLE 1

Figure 2:
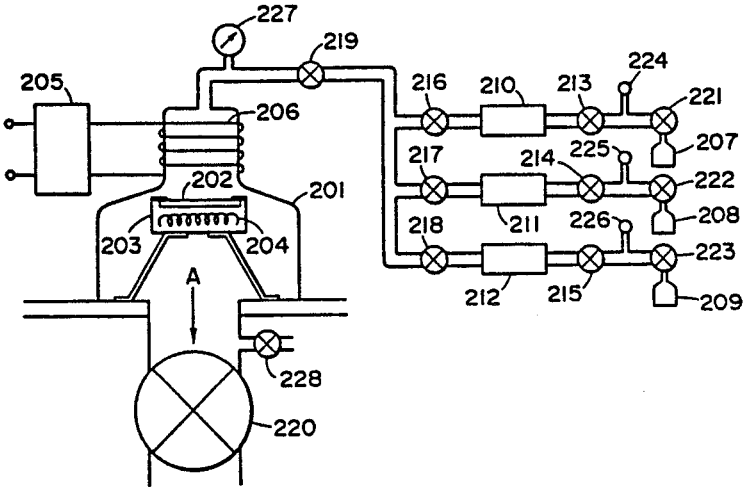
FIGS. 2 and 3 are schematic illustrations of apparatuses which are used to produce and electrophotographic image-forming member according to the present invention.

In accordance with the procedure described below, an electrophotographic image-forming member of the present invention was prepared by using an apparatus as shown in FIG. 2, and image forming treatment was applied to the image-forming member.

A glass substrate (Corning 7059, supplied by Dow Corning Co., 1 mm thick, 4×4 cm size, both side surfaces being polished optically), the surface of which had been cleaned, was provided with an Au layer having a thickness of 200 angstroms on one side surface thereof by the electron beam vapor deposition procedure to form an electrode. The glass substrate was fixed to a fixing member 203 at a predetermined position in a deposition chamber 201 for glow discharge.

The air in the deposition chamber 201 was evacuated by fully opening a main valve 220 to bring the chamber to a vacuum degree of about $5\times10^{-5}$ Torr. A heater 204 was then ignited to heat uniformly the glass substrate to 200° C., and the substrate was kept at this temperature. An auxiliary valve 219 and valve 216 were fully opened, and subsequently a valve 221 of a bomb 207 which had been filled with $SiH_4$ was fully opened, and thereafter, a flow amount controlling valve 213 was gradually opened so that $SiH_4$ gas was introduced into the deposition chamber 201, from the bomb 207. At that time, the vacuum degree in the deposition chamber 201 was brought to and kept at about 0.075 Torr by regulating the main valve 220.

A high frequency power source 205 was switched on to apply a high frequency voltage of 13.56 MHz to an inductance coil 206 so that a glow discharge was generated, thereby forming an a-Si:H layer on the glass substrate. At that time, the glow discharge was initiated with an electric power of 2 W. Further, the growth rate of the a-Si:H layer was about 4 angstroms per second, and the vacuum deposition was carried out for about 40 minutes, and as a result, the thus formed a-Si:H layer was 1.0 micron in thickness.

After completion of the deposition, while the main valve 220, valve 216, flow amount controlling valve 213 and auxiliary valve 219 were closed, a leak valve 228 was opened after the substrate temperature decreased to 100° C. or below, to break the vacuum state in the depostion chamber 201. The resulting structure was taken out from the deposition chamber.

An amorphous selenium (a-Se) layer was further formed with a thickness of 2 microns at a growth rate of 1.0 micron per minute on the a-Si:H layer in accordance with the vacuum vapor deposition. During this procedure, the a-Si:H layer was kept at room temperatures.

The image forming treatment was applied to the thus prepared image-forming member in the following manner.

Negative corona charging was applied to the surface of the image-forming member with a power source voltage of ⊖6 KV in a dark place. The dark decay of the surface potential was observed by means of a surface potential meter. As a result, it was found that 75% or more of the initial potential was retained over several minutes, which showed extremely satisfactory charge retentivity.

Next, electrostatic images were formed on the image-forming members in such a manner that imagewise exposure was conducted by causing light in light energy of about 100 erg to pass through combinations of interference filters and neutral densitofilter ND filter and through a test image pattern onto the image-forming member. At that time, the interference filters for 450, 550 and 650 nm (half width of ±5 nm) were used in combination with the neutral densitofilter so that the light with those wavelengths was irradiated. The images were developed with a positively charged toner powder, thereby providing toner images of high quality with substantially the same light and shade in all cases. Further, also when light having a wave length of 750 nm was used, a good toner image was obtained.

EXAMPLE 2

In the same manner as in Example 1, an aluminum substrate having a thickness of 1 mm and a size of 4×4 cm, the surface of which had been cleaned, was firmly disposed on the fixing member 203 of the same apparatus as that used in Example 1.

The air in the deposition chamber 201 was evacuated by fully opening themain valve 220 to bring the chamber to a vacuum degree of about $5\times10^{-5}$ Torr. The heater 204 was then ignited to heat uniformly the aluminum substrate to 170° C., and the substrate was kept at this temperature. The auxiliary valve 219 was fully opened, and the valve 216 and 221 for the bomb 207 and valves 217 and 222 for bomb 208 were opened, and further the flow amount controlling valves 213 and 214 were gradually opened to introduce $SiH_4$ gas and $B_2H_6$ gas from the bombs 207 and 208, respectively, into the chamber 201. At that time, while the flow meters 210 and 211 were observed, the controlling valves 213 and 214 were regulated so that the flow ratio of $B_2H_6$ to $SiH_4$ ($B_2H_6/SiH_4$) might become 10 ppm. At that time, the vacuum degree in the deposition chamber 201 was brought to and kept at about 0.075 Torr by regulating the main valve 220.

The high frequency power source 205 was switched on to apply a high frequency voltage of 13.56 MHz to the inductance coil 206 so that a glow discharge was caused, thereby forming an a-Si:H layer on the aluminum substrate at a substrate temperature of 170° C. At that time, the glow discharge was initiated with an electric power of 2 W. Further, the growth rate of the a-Si:H layer was about 4 angstroms per second, and the vacuum deposition was carried out for one hour, and as a result, the thus formed a-Si:H layer was 1.5 micron in thickness.

After completion of the deposition, while the main valve 220, valves 216 and 217, flow amount controlling valves 213 and 214, and auxiliary valve 219 were closed, the leak valve 228 was opened after the substrate temperature reached to 100° C. or below, to break the vacuum state in the deposition chamber 210. The resulting structure was taken out from the deposition chamber.

An amorphous $As_2Se_3$ layer was formed with a thickness of one micron at a growth speed of 0.5 micron per minute by the vacuum vapor deposition.

The same image forming treatment as in Example 1 was repeated by using the thus prepared image-forming member. When negative corona charging was carried out with a power of ⊖6 KV, the member exhibited extrememly good charge retentivity concerning negative surface charges at a dark place. Further, when imagewise exposure was performed by using light with wave lengths of 450, 550, 650 and 750 nm, excellent images were obtained.

EXAMPLE 3

In accordance with the procedure described below, an electrophotographic image-forming member was prepared by using an apparatus shown in FIG. 3, and the image formation was carried out with respect to the image-forming member.

A stainless steel plate having a thickness of 0.2 mm and a size of 6×6 cm, the surface of which had been cleaned, was used as a substrate 302 and firmly disposed onto a fixing member 303 involving a heater 304 and a thermocouple in a deposition chamber 301.

A target 305 of silicon dioxide ($SiO_2$) having a purity of 99.9% was fixed onto an electrode 306 opposed to the substrate 302 so that it might be opposed and made parallel to the substrate 302 and further kept apart from the substrate by about 4.5 cm.

The air in the deposition chamber 301 was evacuated by fully opening a main valve 324 to bring the chamber to a vacuum degree of about $5\times10^{-7}$ Torr. At that time, the other valves were closed. An auxiliary valve 323 and outflow valve 320 were opened to evacuate sufficiently the air. Thereafter, the outflow valve 320 and auxiliary valve 323 were closed. Then, a valve 327 of a bomb 308 containing argon gas (purity: 99.9999%) was opened and controlled so that the reading of an outlet pressure guage 331 might indicate to 1 Kg/cm$^2$. Subsequently, an inflow valve 312 was opened, and the outflow valve 320 was also opened gradually to introduce the argon gas into the deposition chamber 301. The outflow valve 320 was gradually opened until the reading of a pressure guage 325 indicated to $5\times10^{-4}$ Torr. After the flow amount became stablized under that state, the main valve 324 was gradually closed and controlled so that the inside pressure in the chamber 301 might reach to $1\times10^{-2}$ Torr.

A high frequency power source 334 was switched on to apply a power of 13.56 MHz, 500 W and 1.6 KV between the target 305 and fixing member 303. Under these conditions, stable discharge was continued for 30 minutes to form a silicon oxide layer in a thickness of 0.2 microns. After the power source 334 was switched off, the outflow valve 320, auxiliary valve 323 and the main valve 324 were closed while a leak valve 335 was opened to bring the inside to the atomsphere.

A target of crystalline silicon (purity 99.999%) was fixed in place of the silicon dioxide targer 305 so that it might be opposed to and kept parallel to and apart from the substrate 302 by 4.5 cm or so. The main valve 324 was fully opened to evacuate the air in the chamber 301 until the vacuum degree reached to about 5'$10^{-7}$ Torr. At that time, the other valves were all closed. The auxiliary valve 323 and outflow valves 319, 320 and 321 were opened to sufficiently evacuate the air, and the outflow valves 319, 320 and 321 and auxiliary valve 323 were then closed.

The substrate 302 was heated by the heater 304 to 170° C. and kept at this temperature. While the pressure guage 330 was observed, a valve 326 of a hydrogen gas bomb 307 was gradually opened to adjust the outlet pressure to 1 Kg/cm$^2$. An inflow valve 311 was gradually opened to introduce hydrogen gas (purity 99.99995%) into a flow meter 315. A outflow valve 319 and auxiliary valve 323 were successively opened. The inflow valve 319 was controlled to introduce the hydrogen gas into the chamber 301 until the inside pressure of the chamber reached to $5\times10^{-5}$ Torr while the pressure guage 325 was observed.

The valve 327 of the argon gas bomb 308 was opened to adjust the reading of the outlet pressure guage 331 to 1 Kg/cm$^2$. The inflow valve 312 and outflow valve 320 were successively opened to introduce argon gas (purity 99.9999%) into the chamber 301. The inflow valve 320 was gradually opened until the pressure guage 325 indicated to $5\times10^{-4}$ Torr. After the flow amount became stable under that condition, the main valve 324 was gradually closed and regulated to bring the chamber 301 to $1\times10^{-2}$ Torr.

After the flow meters 315 and 316 became stable, the power source 334 was switched on to apply a power of 13.56 MHz, 150 W and 1.6 KV between the target 305 of crystalline silicon and fixing member 303. Under those conditions, stable discharge was kept and continued for 1.5 hours to form a layer. Subsequently, the power source 334 was switched off to discontinue the discharge. The outflow valve 319 and 320 were closed while the main valve 324 724 was fully opened to evacuate the gas in the chamber 301 so that the inside of the chamber might be brought to a cacuum degree of $5\times10^{-7}$ Torr.

After the temperature of the substrate 302 reached to 100° C. or below, the main valve 324 was closed while the leak valve 335 was opened to break the vacuum state. The substrate was then taken out from the chamber.

Further, in the same manner as that in Example 1, an a-Si:H layer was formed in a thickness of 0.5 microns to prepare an image-forming member.

The image-forming member was tested with respect to the same image formation as that conducted in Example 1. The member exhibited very slow dark decay when negative corona discharge was applied with ⊖6 KV and it provided clear and sharp toner images with good light and shade when imagewise exposure was carried out with light in wavelength ranges of 400, 450, 500, 550, 600, 650, 700, 750 and 800 nm (half width of 10 nm) to form electrostatic images, and these images were developed with positively charged toner. Further, also when positive corona charging was carried out, the dark decay was slow and electrostatic images formed by the imagewise exposure were developed with negatively charged toner to give toner images with high quality.

EXAMPLE 4

An ITO ($In_2O_3$: $SnO_2$=20:1 shaped, burned at 600° C.) layer having a thickness of 1200 angstroms was formed on one side surface of a glass substrate (trade name: Corning 7059, supplied by Dow Corning Co.) having a thickness of 1 mm and a size of 4×4 cm, the both sides of which had been optically polished, in accordance with the electron beam vapor deposition procedure. The resulting structure was heated at 500° C. in atmosphere of oxygen.

Figure 3:
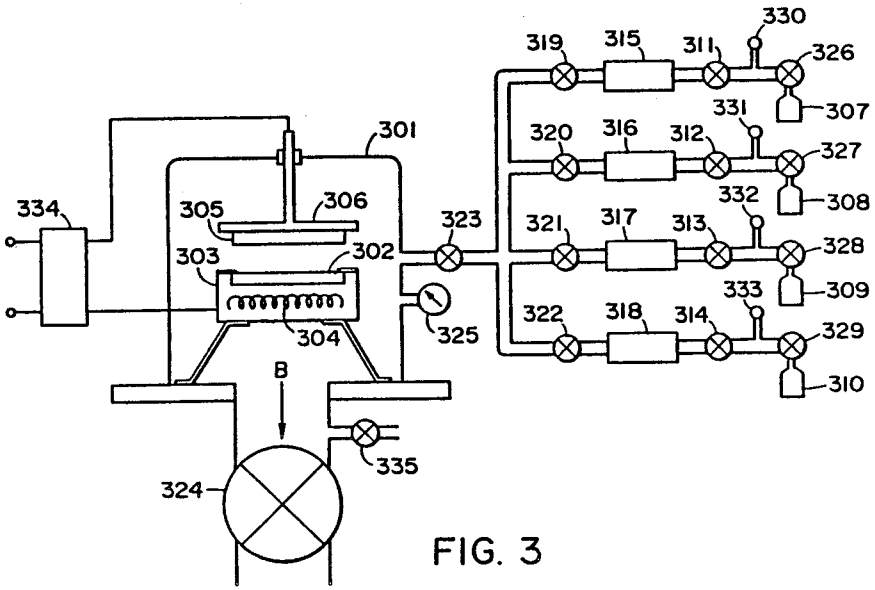

The structure was disposed at the fixing member 303 in the apparatus shown in FIG. 3 similar to that used in Example 3 so that the ITO layer might be faced upward. Subsequently, in accordance with the same procedure as in Example 3, the inside of the deposition chamber 301 was adjusted to a vacuum degree of $5\times10^{-6}$ Torr, and the substrate temperature was kept at 200° C., and thereafter, gas mixture of argon and hydrogen (1:10) was allowed to flow into the chamber 301 so that the inside of the chamber 301 was brought to $2\times10^{-2}$ Torr. After the gas flow was stabilized and the inside pressure of the chamber 301 was made constant and further the substrate temperature became stable at 200° C., the high frequency power source 334 was switched on to initiate discharge in accordance with the same manner as in Example 3. Under the conditions, the discharge was continued for 45 minutes. Thereafter, the power source 334 was switched off to discontinue the discharge.

A valve 328 of an oxygen gas bomb 309 was opened to adjust the outlet pressure to 1 $Kg/cm^2$, and outflow valve 313 and inflow valve 321 were gradually opened and regulated so that the reading of a flow meter 317 might indicate to 5% by volume of oxygen gas based on the flow amount of the hydrogen gas. After the flow amount of the argon gas, hydrogen gas and oxygen gas was stabilized, the power source 334 was again switched on to reopen and continue the discharge for one hour.

After the discharge was discontinued, the outflow valves 319, 320 and 321, and auxiliary valve 323 were closed while the main valve 324 was fully opened to recover a vacuum state in the inside of the chamber 301. When the substrate temperature reached to 100° C. or below, the main valve 324 was closed while the leak valve 335 was opened to break the vacuum state.

The thus obtained image-forming member was used for the image-forming process comprising negative charging with ⊖6 KV and imagewise exposure in the same manner as in Example 1, to obtain toner images. As a result, good images were obtained with high sharpness. Further, even when imagewise exposure was carried out with light in wavelength ranges of 450, 550, 650, and 750 nm (half width of 10 nm) good toner images were obtained. After about 10 seconds elapsed since the corona charging, the obtained toner images were hardly deteriorated in the density and sharpness.

EXAMPLE 5

In the same procedure as in Example 3, a silicon oxide layer having a thickness of 0.2 microns was formed on a substrate 302 by means of the same apparatus as shown in FIG. 3. At that time, a cleaned aluminum plate having a thickness of 0.5 mm and a size of 5×5 cm was used as the substrate 302, and silicon dioxide target 305 was used. Further, an a-Si:H layer and a-Si:H (O) layer, having thicknesses of 1.0 micron and 0.5 microns resectively, were formed in accordance with the same procedure as in Example 4, to prepare an image-forming member.

The image-forming treatment was applied to the thus obtained member in the same manner as in Example 1. When negative corona charging was carried out with ⊖6 KV, the dark decay speed was extremely low. Further, when imagewise exposure was effected with light in wavelength ranges of 450, 550, 650 and 750 nm (half width of 10 nm), good images were obtained with high density. Similar results were obtained in case of carrying out positive corona charging with ⊕6 KV.

EXAMPLE 6

Similarly to the case of Example 4, the glass substrate provided with an ITO electrode thereon was used as a substrate. A layer of $AsSe_{19}$ chalcogenide glass was formed in a thickness of 5 microns by the vacuum vapor deposition under the conditions that the substrate temperature was 45° C. and deposition rate was 0.3 microns per minute.

The substrate structure was disposed at the fixing member 203 in the apparatus shown in FIG. 2 so that its chalcogenide glass layer surface might be faced upward in the same manner as in Example 1. After the air in the chamber 201 was evacuated to bring the inside thereof to a vacuum state, an a-Si:H layer was formed in a thickness of 1.0 micron with the substrate being maintained at 70° C.

When positive corona charging with ⊖6 KV was applied to the image-forming member thus obtained, the dark decay speed was low. Thereafter, the process including imagewise exposure and development with a toner was carried out so that toner images were obtained with high quality.

Further, when imagewise exposure was carried out from the back surface of the image-forming member, i.e. the side of the substrate after the positive corona charging was applied with ⊖6 KV, good tonor images were obtained with high image density in all cases of using light in wavelength ranges of 450, 550, 650, and 750 nm (half width of 10 nm) in the imagewise exposure.

Separately, another image-forming member was prepared by using the same procedure and conditions as mentioned above except that the substrate temperature was kept at 200° C. and an $As_2Se_3$ layer of 20 μ thickness instead of the $AsSe_{19}$ layer and an a-Si:H layer of 1 μ thickness were formed on the substrate. When the visible image formation was carried out in the same manner as mentioned above, that member gave high quality toner images on transfer papers.

EXAMPLE 7

In the same manner as in Example 6, a structure composed of glass substrate, ITO electrode, a-$AsSe_{19}$ layer and a-Si:H layer was obtained. This structure was firmly disposed at the fixing member 303 in the apparatus shown in FIG. 3 so that its a-Si:H layer might be faced upward, similarly to Example 4. Sputtering procedure was carried out by using a target of polycrystalline silicon in gas mixture atmosphere of Ar: $H_2$: $O_2$=100:20:1 and maintaining the substrate temperature at room temperature to laminate an a-Si:H (O) layer having a thickness of 0.3 microns.

Positive corona charging with ⊕6 KV was applied to the thus obtained image-forming member. As a result, the dark decay was extremely slow. When imagewise exposure was then carried out with light in wavelengths of 450, 550, 650 and 750 nm (half width of 10 nm) and development was effected with a toner, good toner images were obtained with high quality in all cases.

EXAMPLE 8

Similarly to the case of Example 4, a glass substrate provided with ITO electrodé thereon was used as a substrate. An a-Si:H layer having a thickness of one micron was formed on the ITO substrate by the glow discharge in accordance with the same operation as in Example 1. Thereafter the power source 205 was switched off to discontinue the discharge.

A valve 222 of a bomb 208 containing diborane gas (purity: 99.999%) therein was opened to adjust the outlet pressure to 1 $Kg/cm^2$, and thereafter an inflow valve 214 and outflow B valve 217 were gradually opened and regulated so that the flow amount of the diborane gas might be 100 ppm based on that of the silane gas. This regulation was conducted by observing the reading of a flow meter 211. After the flow amount became stable, the power source 205 was again switched on to reopen and continue glow discharge for 15 minutes.

Again, the power source 205 was switched off, and auxiliary valve 219, outflow valves 216 and 217 and inflow valves 213 and 214 were closed while the main valve 220 was fully opened. After the substrate temperature reached to 100° C. or below, the main valve 220 was closed and the leak valve 228 was opened to break the vacuum state. The structure provided with an a-Si:H layer thereon was taken out.

Subsequently, an a-$AsSe_{19}$ layer having a thickness of 0.8 microns was formed on the a-Si:H layer by the vacuum vapor deposition. At that time, the deposition rate was 0.3 microns per minute.

The image-forming treatment was applied to the thus prepared image-forming member in the same manner as in Example 1. When negative corona charging with ⊖6 KV was applied, the dark decay was extremely slow and the light decay was excellent in the imagewise exposure with light in wavelengths of 400–800 nm, which was confirmed from toner images.

EXAMPLE 9

In the same manner as in Example 3, a silicon oxide layer was formed in a thickness of 0.2 microns on a stainless steel substrate having a thickness of 0.2 mm and a size of 4×4 cm. The resulting structure was firmly disposed at the fixing member 203 of the apparatus shown in FIG. 2.

Subsequently, the air in the deposition chamber 201 for glow discharge was evacuated to adjust the inside thereof to a vacuum degree of $5\times10^{-6}$ Torr by the same operation as in Example 2. The substrate was kept at 200° C. Silane gas was allowed to flow into the chamber 201 so that the vacuum degree of the inside thereof was adjusted to 0.1 Torr. At that time, diborane gas was introduced into the chamber 201 through the valve 222 from the bomb 208 simultaneously with the silane gas in the form of gas mixture, under gas pressure of 1 $Kg/cm^2$ (the reading of the outlet pressure guage 225). The flow amount of the diborane gas was adjusted to 10 ppm based on that of the silane gas by controlling the inflow valve 214 and outflow valve 217 while the flow meter 211 was observed.

After the gas flow was stabilized and the inside pressure of the chamber 201 was maintained constant and further the substrate temperature became stable, the power source 205 was switched on to initiate and continue glow discharge for 50 minutes. Thereafter, the power source 205 was switched off to discontinue the glow discharge.

Subsequently, the valve 216, 217, auxiliary valve 219, and main valve 220 were fully opened to bring the chamber 201 to a vacuum state of $5\times10^{-6}$ Torr. Then, the auxiliary valve 219 and main valve 220 were closed. The outflow valve 216 was gradually opened, and auxiliary valve 219 and main valve 220 were controlled to establish silane gas flow in the same flow amount as mentioned above.

A valve 223 of a phosphine gas bomb 209 was opened to adjust the gas pressure to 1 $Kg/cm^2$ while the outlet pressure guage 226 was observed. Inflow valve 215 and outflow valve 218 were gradually opened to introduce phosphine gas into the chamber 201 in gas mixture with the silane gas. At that time, while the flow meter 212 was observed, the inflow valve 215 and outflow valve 218 were controlled so that the flow amount of the phosphine gas might be 150 ppm based on that of the silane gas. The high frequency power source 205 was switched on to reopen and continue glow discharge for 10 minutes.

Thereafter, the heater 204 and power source 205 were switched off, and outflow valves 216 and 218 were closed while the main valve 220 and auxiliary valve 219 were fully opened to bring the inside of the chamber 201 to $10^{-5}$ Torr or below. After the substrate temperature reached to 100° C. or below, the auxiliary valve 219 and main valve 220 were closed, and the leak valve 228 was opened. The resulting structure was taken out from the chamber 201.

The thus obtained stainless steel substrate provided with an a-Si:H layer was firmly disposed at the fixing member 303 in the apparatus shown in FIG. 3. Subsequently, an a-Si:H (O)layer was formed by the same operation as that used for forming the top layer in Example 4. At that time, the gas flow amount of Ar: $H_2$: $O_2$=90:10:0.5 was established, and a target of polycrystalline silicon was used, and further the discharge was maintained for 30 minutes.

The thus prepared image-forming member was subjected to positive corona charging with ⊕6 KV in a dark place so that it exhibited remarkably excellent charge retentivity and extremely slow dark decay. When imagewise exposure was then carried out with light in wavelength of 400, 500, 600, 700 and 800 nm (half width of 10 nm) and development was successively effected with a negatively charged toner, good toner images were obtained with excellent density, gradation and sharpness in all cases of using light of the above wavelengths.

EXAMPLE 10

In accordance with the same procedure as in Example 1, an Au electrode was formed on the glass substrate, and an a-Si:H layer having a thickness of one micron was further formed thereon. After the glow discharge was discontinued, the outflow valve 216 was closed so that the inside of the chamber 201 was maintained in a vacuum state.

A bomb 209-1 containing therein methane gas (purity: 99.95%) was mounted in place of the phosphine gas bomb 209. the valve 223 of the bomb 209-1 was maintained closed while the inflow valve 215, outflow valve 218 and auxiliary valve 219 were fully opened to bring the inside of the system to a vacuum state. Successively, the valves 215 and 218 were closed while the valve 223 was opened and controlled to adjust the outlet pressure to 1 $Kg/cm^2$.

The inflow valve 216 was gradually opened to adjust the flow amount of the silane gas to that in the case of forming the a-Si:H layer. The inflow valve 215 and outflow valve 218 were also gradually opened to introduce the methane gas into the chamber 201. At that time, the flow amount of the methan gas was controlled to 10% by volume based on that of the silane gas. Under those conditions, the high frequency power source 205 was again switched on to continue glow discharge for 40 minutes.

After the power source 205 was switched off, the outflow valves 216 and 218 and auxiliary valve 219 were closed to recover a vacuum state in the chamber 201. The heater 204 was switched off to allow the substrate temperature to decrease to 100° C. or below. The leak valve 228 was opened. The thus prepared image-forming member was taken out from the apparatus.

The image-forming member was subjected to negative corona charging with ⊖6 KV, imagewise exposure using light in wavelengths of 450, 550, 650 and 750 nm (half width of 10 nm) and development with a positively charged toner. As a result, in all cases, good toner images were obtained with excellent sharpness and high image density.

EXAMPLE 11

In the same manner as in Example 1, an Au layer was formed on the glass substrate by using the apparatus shown in FIG. 2. Further, under the same conditions as in Example 1, an a-Si:H layer of 3 microns thickness and a-Se layer of 6 microns were successively laminated. Polycarbonate resin was uniformly coated in a thickness of 10 microns after drying onto the a-Se layer to form a transparent insulating layer.

The corona discharge with ⊕6 KV was applied to the whole surface of the insulating layer of the thus prepared image-forming member as the primary charge. At the same time, the whole surface exposure was uniformly carried out from the insulating layer side. Thereafter, the image-forming member was placed again in a dark place and subjected to corona discharge with ⊖5.5 KV as the secondary charge silultaneously with imagewise exposure with light of wavelengths of 450, 550, 650 and 750 nm (half width of 10 nm). Again, the whole surface exposure was uniformly carried out on the surface of the image-forming member. Further, development with a negatively charged toner, transferring onto a transfer paper and fixation were successively carried out. In all cases, excellent images were obtained with high resolution and sharpness.

EXAMPLE 12

In accordance with the same procedure as in Example 1, an Au layer, an a-Si:H layer of one micron thickness and a-Se layer of two microns thickness were laminated on the glass substrate by using the apparatus shown in FIG. 2. Polyvinyl carbazole was coated in a thickness of 10 microns after dying onto the a-Se layer to prepare an image-forming member.

The thus prepared image-forming member was subjected to corona charging with ⊖6 KV, imagewise exposure with light of wavelengths of 450, 550, 650 and 750 nm and development with a positively charged toner. As a result, very good toner images were obtained in all cases of using light of the above wavelengths.

What we claim is:

1. A process for preparing an electrophotographic image-forming member comprising a substrate, a hydrogenated amorphous silicon layer containing from 1 to 40 atomic percent of hydrogen and an amorphour inorganic semiconductor layer composed of an amorphour inorganic semiconductor having band gap $e_g$ larger than the band gap $E_g$ of said hydrogenated amorphous silicon and having effective dark resistance for forming electrophotographic images; said hydrogenated amorphorous silicon layer being laminated to said amorphous inorganic semiconductor layer whereby a heterojunction is provided in the contact portion between the former layer and the latter layer which comprises the steps of:

(a) subjecting a substrate suitable for electrophotography to a reduced pressure in an evacuable system;

(b) introducing gasious material comprising hydrogenated silicon gas and hydrogen gas into said system under said reduced pressure;

(c) causing an electrical discharge in said gaseous material so as to form a hydrogenated amorphous silicon layer containing from 1 to 40 atomic percent of hydrogen on the substrate while maintaining the temperature of said substrate within a predetermined temperature range;

(d) depositing amorphous inorganic semiconductor on said hydrogenated amorphous semiconductor layer by vacuum vapor deposition so as to form an amorphous inorganic semiconductor layer; and (e) after said layer is formed, maintaining the layer under reduced pressure until the temperature of the substrate drops to or below a predetermined temperature.

* * * * *

UNITED STATES PATENT AND TRADEMARK OFFICE

CERTIFICATE OF CORRECTION

PATENT NO. :4,877,709

DATED :October 31, 1989

INVENTOR(S) :EIICHI INOUE, ET AL.

It is certified that error appears in the above-identified patent and that said Letters Patent is hereby corrected as shown below:

On the title page:

IN [56] REFERENCES CITED

U.S. PATENT DOCUMENTS, "Oushinsky et al." should read --Ovshinsky et al.--.

COLUMN 2

Line 5, "controlled" should read --controlled,--.

COLUMN 3

Line 39, "imageforming" should read --image-forming--.

COLUMN 4

Line 18, "and" should read --an--.
Line 41, "contrast" should read --contact--.
Line 51, "donor." should read --donor, Nd;--.

COLUMN 5

Line 9, "type" should read --type,--.
Line 39, "insert gas" should read --inert gas--.
Line 40, "insert gas," should read --inert gas,--.

COLUMN 7

Line 66, "name order" should read --named order--.

UNITED STATES PATENT AND TRADEMARK OFFICE

CERTIFICATE OF CORRECTION

PATENT NO. : 4,877,709

DATED : October 31, 1989

INVENTOR(S) : EIICHI INOUE, ET AL.

It is certified that error appears in the above-identified patent and that said Letters Patent is hereby corrected as shown below:

COLUMN 8

Line 8, "teh" should read --the--.
Line 14, "repeated" should read --repeatedly--.
Line 17, "other many" should read --many other--.
Line 47, "2,4-benzpyrene," should read --3,4-benzpyrene,--.

COLUMN 9

Line 10, "desscsribed" should read --described--.
Line 39, "surface" should read --surfaces--.
Line 68, "substrate. In" should read --substrate. ¶ In--.

COLUMN 10

Line 15, "inorganic ompounds" should read --organic compounds--.
Line 46, "polychrylene" should read --polyethylene--.
Line 57, "than" should read --then--.

COLUMN 11

Line 48, "depostion" should read --deposition--.

UNITED STATES PATENT AND TRADEMARK OFFICE

CERTIFICATE OF CORRECTION

PATENT NO. : 4,877,709

DATED : October 31, 1989

INVENTOR(S) : EIICHI INOUE, ET AL.

It is certified that error appears in the above-identified patent and that said Letters Patent is hereby corrected as shown below:

COLUMN 12

Line 17, "surface" should read --surfaces--.
Line 21, "themain" should read --the main--.
Line 26, "valve 216 and 221" should read --valves 216 and 221--.
Line 33, "flow ratio" should read --flow amount ratio--.
Line 64, "extrememly" should read --extremely--.

COLUMN 13

Line 27, "guage" should read --gauge--.
Line 32, "guage" should read --gauge--.
Line 33, "stablized" should read --stabilized--.
Line 51, "5'$10^{-7}$ Torr." should read --5X$10^{-7}$ Torr.--.
Line 59, "guage" should read --gauge--.
Line 63, "A" should read --An--.
Line 68, "guage" should read --gauge--.

COLUMN 14

Line 2, "guage" should read --gauge--.
Line 6, "guage" should read --gauge--.
Line 19, "main valve 324 724" should read --main valve 324--.
Line 21, "cacuum" should read --vacuum--.

UNITED STATES PATENT AND TRADEMARK OFFICE

CERTIFICATE OF CORRECTION

PATENT NO. : 4,877,709

DATED : October 31, 1989

INVENTOR(S) : EIICHI INOUE, ET AL.

It is certified that error appears in the above-identified patent and that said Letters Patent is hereby corrected as shown below:

COLUMN 16

Line 7, " ⊖6 KV" should read -- ⊕6 KV--.
Line 16, " ⊖6 KV," should read -- ⊕6 KV,-- and "tonor" should read --toner--.
Line 61, "outflow B valve 217" should read --outflow valve 217--.

COLUMN 17

Line 38, "guage" should read --gauge--.
Line 50, "valve 216, 217," should read --valves 216, 217,--.
Line 61, "guage" should read --gauge--.

COLUMN 18

Line 26, "wavelength" should read --wavelengths--.
Line 43, "the" (first occurrence) should read --The--.
Line 55, "methan gas" should read --methane gas--.

COLUMN 19

Line 23, "silultaneously" should read --simultaneously--.

UNITED STATES PATENT AND TRADEMARK OFFICE

CERTIFICATE OF CORRECTION

PATENT NO. :4,877,709

DATED :October 31, 1989

INVENTOR(S) :EIICHI INOUE, ET AL.

It is certified that error appears in the above-identified patent and that said Letters Patent is hereby corrected as shown below:

COLUMN 20

Line 10, "amorphour" should read --amorphous--.
Line 11, "amorphour" should read --amorphous--.
Line 12, "band gap $e_g$" should read --band gap $E_g$--.
Line 16, "phorous" should read --phous--.
Line 24, "gasious" should read --gaseous--.

Signed and Sealed this

Thirteenth Day of August, 1991

*Attest:*

HARRY F. MANBECK, JR.

*Attesting Officer*

*Commissioner of Patents and Trademarks*